US011950668B2

(12) United States Patent
Lau

(10) Patent No.: US 11,950,668 B2
(45) Date of Patent: Apr. 9, 2024

(54) CONVERTIBLE CASE FOR PORTABLE ELECTRONIC DEVICE

(71) Applicant: COLEBROOK BOSSON & SAUNDERS (PRODUCTS) LIMITED, London (GB)

(72) Inventor: Alex Lau, London (GB)

(73) Assignee: COLEBROOK BOSSON & SAUNDERS (PRODUCTS) LIMITED, London (GB)

( * ) Notice: Subject to any disclaimer, the term of this patent is extended or adjusted under 35 U.S.C. 154(b) by 0 days.

(21) Appl. No.: 17/607,755

(22) PCT Filed: May 1, 2020

(86) PCT No.: PCT/GB2020/051089
§ 371 (c)(1),
(2) Date: Oct. 29, 2021

(87) PCT Pub. No.: WO2020/225546
PCT Pub. Date: Nov. 12, 2020

(65) Prior Publication Data

US 2022/0218084 A1 Jul. 14, 2022

Related U.S. Application Data

(60) Provisional application No. 62/842,808, filed on May 3, 2019.

(51) Int. Cl.
*A45C 11/00* (2006.01)
*A45C 5/00* (2006.01)

(52) U.S. Cl.
CPC ..... *A45C 11/00* (2013.01); *A45C 5/00* (2013.01); *A45C 2011/003* (2013.01); *A45C 2200/15* (2013.01)

(58) Field of Classification Search
CPC ..... A45C 11/00; A45C 5/00; A45C 2011/003; A45C 2200/15
(Continued)

(56) References Cited

U.S. PATENT DOCUMENTS 3,025,954 A * 3/1962 Massey ..... A45C 9/00 206/45.2
8,393,464 B2 * 3/2013 Yang ..... A45C 11/00 206/320
(Continued)

FOREIGN PATENT DOCUMENTS

CN 101749524 A 6/2010
CN 102613795 A 8/2012
(Continued)

OTHER PUBLICATIONS

International Search Report and Written Opinion for Application No. PCT/GB2020/051089 dated Jun. 15, 2020 (10 pages).
(Continued)

*Primary Examiner* — Rafael A Ortiz
(74) *Attorney, Agent, or Firm* — MICHAEL BEST & FRIEDRICH LLP

(57) ABSTRACT

In some aspects, a convertible case (10) for a portable electronic device includes a bottom surface (18) having a first panel. A top surface (14) is moveably coupled to the bottom surface (18). The top surface (14) has a second panel. The bottom surface (18) and the top surface (14) at least partially define a cavity (34) having an opening. The bottom surface (18) and top surface (14) are moveable with respect to one another between a storage configuration and a working configuration. In the storage configuration the opening has a first size, and the cavity (34) and the opening are sized to receive a portable electronic device. In the working configuration the opening has a second size larger than the
(Continued)

first size, and the bottom and top surface (18,14) are positioned to support the portable electronic device.

16 Claims, 14 Drawing Sheets

(58) Field of Classification Search
USPC ..... 206/45.2
See application file for complete search history.

(56) References Cited

U.S. PATENT DOCUMENTS

| | | | | |
|---|---|---|---|---|
| 8,820,695 | B2 * | 9/2014 | Nakada | A45C 13/1069 248/455 |
| 9,038,979 | B2 * | 5/2015 | Lu | F16M 13/00 248/152 |
| 10,154,127 | B1 * | 12/2018 | Zaccaria | A45C 13/001 |
| 2006/0285283 | A1 | 12/2006 | Simonian et al. | |
| 2012/0305413 | A1 | 12/2012 | Chung | |
| 2013/0341233 | A1 * | 12/2013 | Dow | A45C 11/00 206/521 |
| 2015/0041341 | A1 * | 2/2015 | Marshall | G06F 3/0221 206/320 |
| 2015/0122850 | A1 | 5/2015 | Quehl | |
| 2015/0296643 | A1 * | 10/2015 | Lee | A45C 11/00 206/45.2 |
| 2015/0296946 | A1 * | 10/2015 | Buechin | A45C 11/00 206/45.23 |
| 2017/0099921 | A1 * | 4/2017 | Sirichai | H05K 5/0234 |
| 2019/0097669 | A1 * | 3/2019 | Zaccaria | H04B 1/3877 |
| 2020/0121046 | A1 * | 4/2020 | Buechin | A45C 11/00 |
| 2020/0187613 | A1 * | 6/2020 | Dabov | A45C 15/00 |

FOREIGN PATENT DOCUMENTS

| | | | | |
|---|---|---|---|---|
| EP | 2657807 | A2 | 10/2013 | |
| GB | 2526421 | * | 11/2015 | |
| GB | 2526421 | A * | 11/2015 | A45C 11/00 |
| KR | 20130137411 | A | 12/2013 | |
| WO | 2016057340 | A1 | 4/2016 | |

OTHER PUBLICATIONS

European Patent Office Action for Application No. 20724927.7 dated Nov. 29, 2022 (6 pages).
Chinese Patent Office Action for Application No. 202080048880.3 dated Aug. 22, 2023 (20 pages including English translation).
European Patent Office Action for Application No. 20724927.7 dated Sep. 13, 2023 (5 pages).

* cited by examiner

CONVERTIBLE CASE FOR PORTABLE ELECTRONIC DEVICE

RELATED APPLICATION(S)

This application is based on U.S. Provisional Ser. No. 62/842,808, filed May 3, 2019, the disclosure of which is incorporated herein by reference in its entirety and to which priority is claimed.

FIELD

Various aspects relate to a case for a portable electronic device and more particularly, to a convertible case for carrying a portable electronic device and supporting the device in a working position.

SUMMARY

In some aspects, a convertible case for a portable electronic device includes a bottom surface having a first panel. A top surface is moveably coupled to the bottom surface. The top surface has a second panel. The bottom surface and the top surface at least partially define a cavity having an opening. The bottom surface and top surface are moveable with respect to one another between a storage configuration and a working configuration. In the storage configuration the opening has a first size, and the cavity and the opening are sized to receive a portable electronic device. In the working configuration the opening has a second size larger than the first size, and the bottom and top surface are positioned to support the portable electronic device.

In some aspects, a convertible case for a portable electronic device includes a bottom surface having a first central panel, a first side panel moveably coupled to the first central panel with a first hinge, a second side panel moveably coupled to the first central panel with a second hinge, and a first end panel moveably coupled to the first central panel with a third hinge. A top surface is moveably coupled to the bottom surface. The top surface includes a second central panel, a third side panel moveably coupled to the second central panel with a fourth hinge, a fourth side panel moveably coupled to the second central panel with a fifth hinge, and a second end panel moveably coupled to the second central panel with a sixth hinge. The bottom surface and the top surface at least partially define a cavity and an opening. The bottom surface is moveable relative to the top surface between a first position and a second position. The size of the opening increases as the bottom surface moves between the first position and the second position.

Other aspects of the invention will become apparent by consideration of the detailed description and accompanying drawings.

DETAILED DESCRIPTION

It is to be understood that the invention is not limited in its application to the details of construction and the arrangement of components set forth in the following description or illustrated in the following drawings. The invention is capable of other embodiments and of being practiced or of being carried out in various ways.

Figure 1:
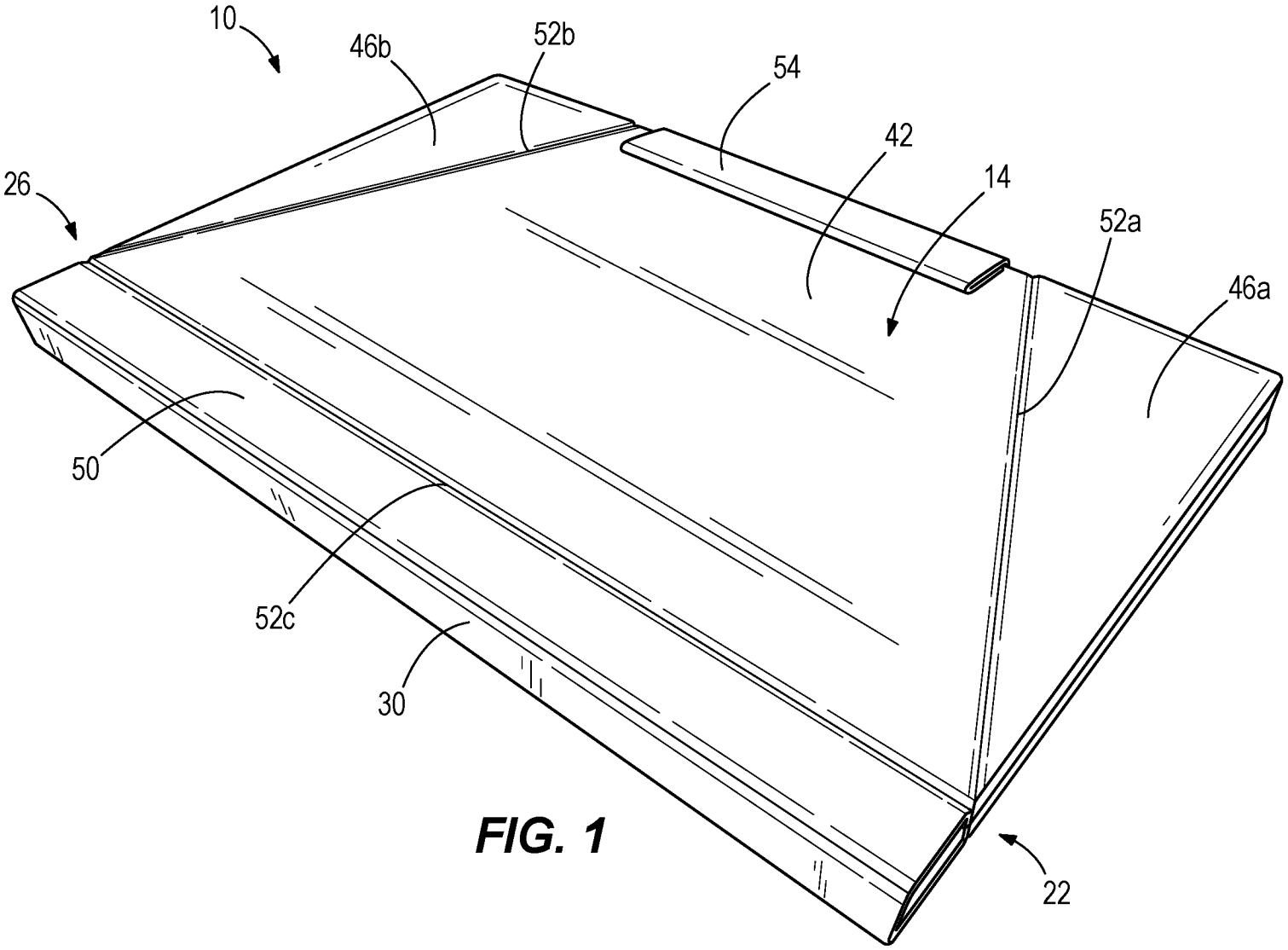
FIG. 1 is a rear perspective view of an exemplary case in a dosed position.
Figure 2:
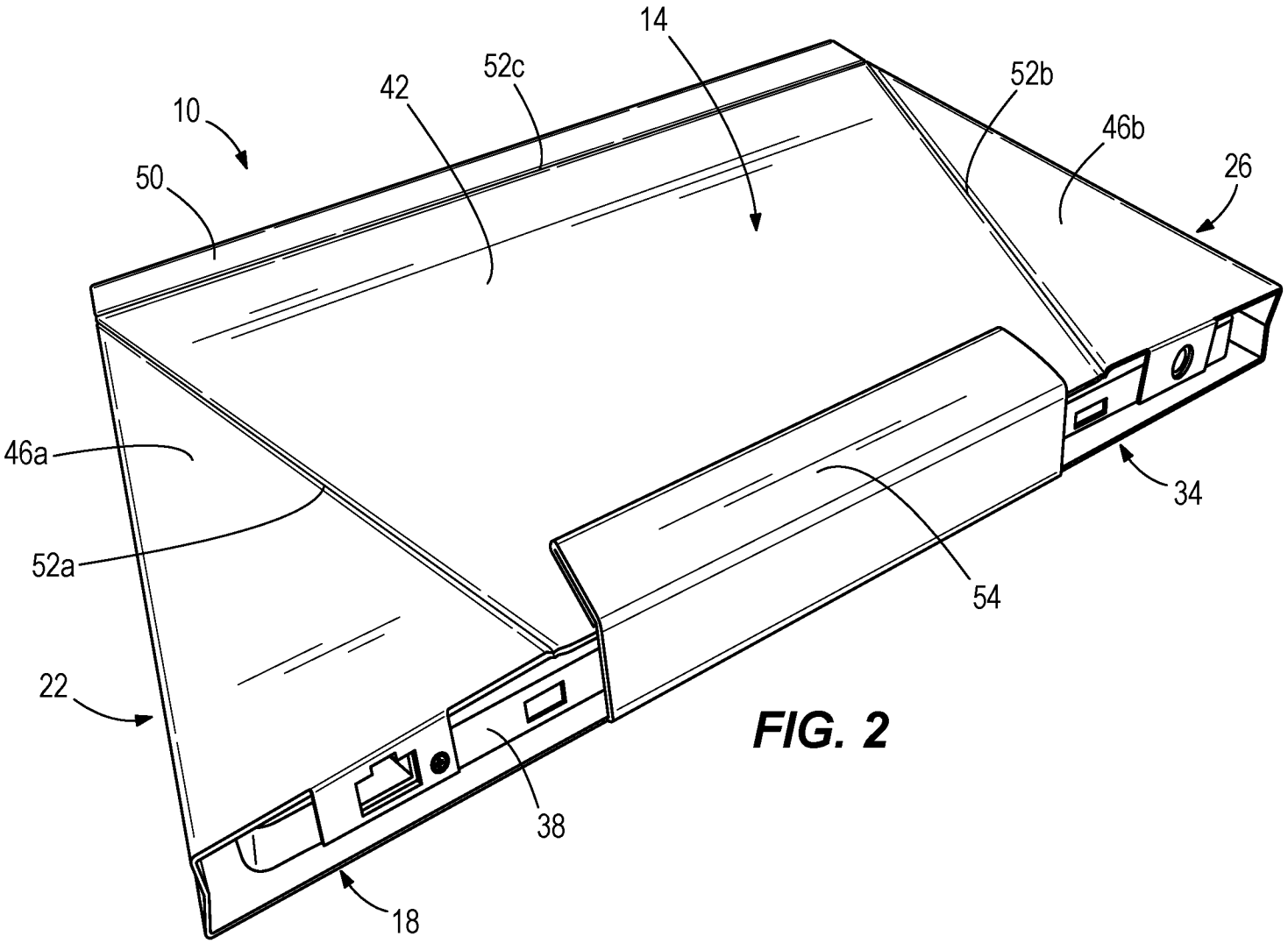
FIG. 2 is a front perspective view of the case of FIG. 1 in the dosed position.
Figure 3:
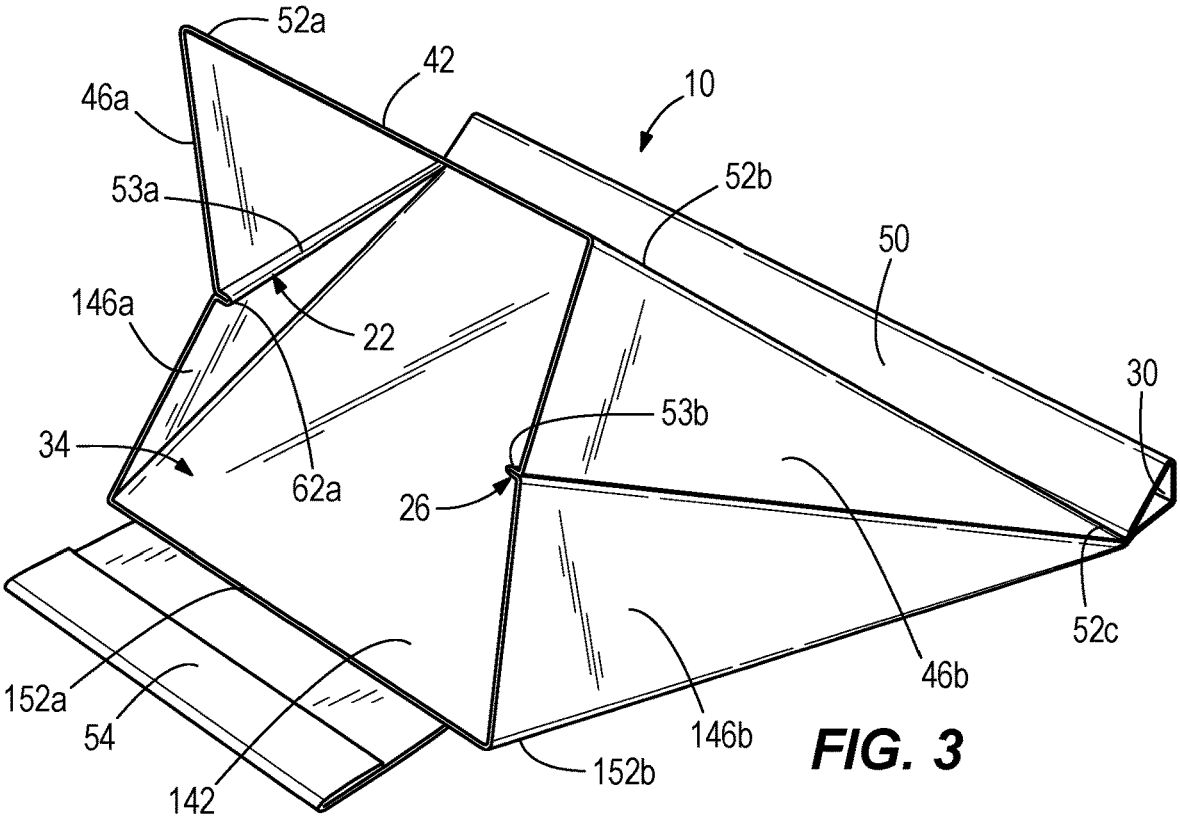
FIG. 3 is a front perspective view of the case of FIG. 1 in an opened position.
Figure 4:
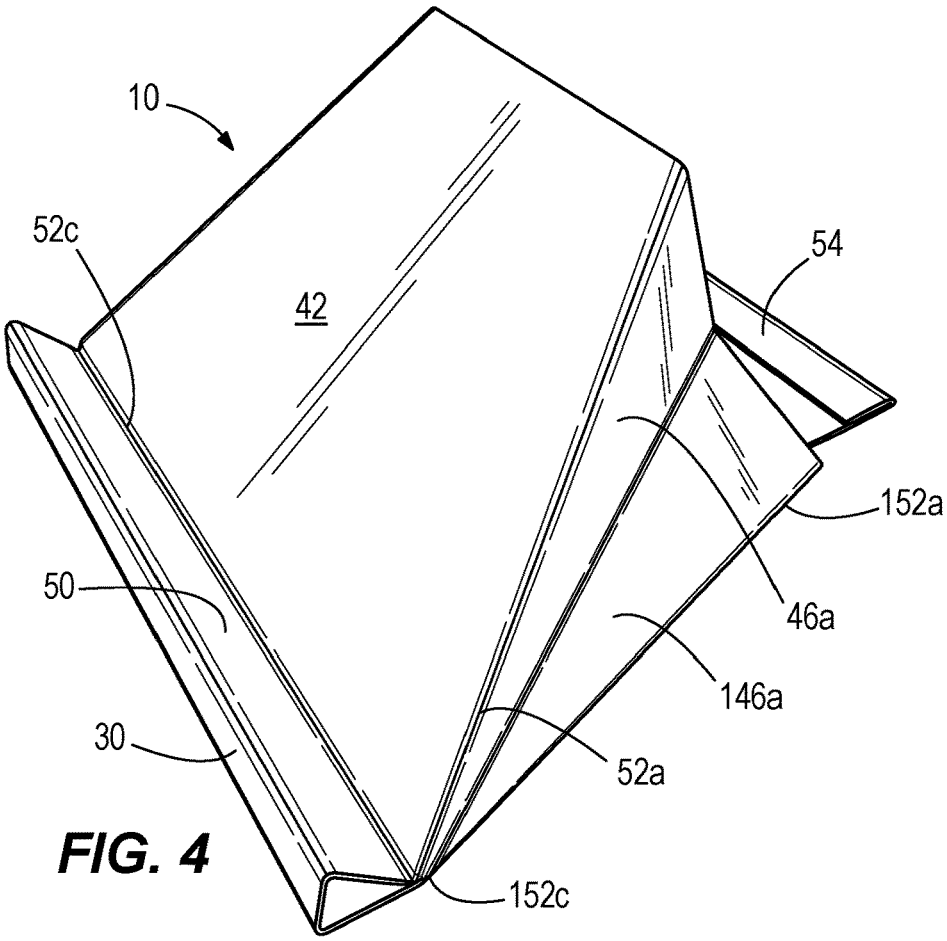
FIG. 4 is a rear perspective view of the case in FIG. 1 in the open position.

FIGS. 1-18 depict an exemplary embodiment of a carry case 10 for a portable electronic device depicted as a laptop in the illustrated embodiment. The case 10 can be configured for other portable electronic computing device, (e.g., tablets, smart phones, etc.). The case 10 is convertible from a carry or storage position (as shown, for example, in FIGS. 1 and 2) where the case 10 receives the electronic device in an interior cavity for transport and one or more working configurations (as shown, for example, in FIGS. 3-8) where the electronic device can rest on the case 10 for use by a user.

As shown in FIGS. 1-2 and 9-10, a case 10 includes a first or top surface or wall 14 and a second or bottom surface or wall 18 that is opposite the top surface 14. A third or left surface or wall 22 and a fourth or right surface or wall 26 each are positioned between the top and bottom surfaces 14, 18. A fifth or rear surface 30 is positioned between the top and bottom surfaces 14, 18, as well as between the left and right surfaces 22, 26. When assembled, the surfaces 14, 18, 22, 26, 30 together define a cavity 34 (see e.g., FIG. 2). In the illustrated embodiment, the surfaces 14, 18, 22, 26, 30 and the cavity 34 are sized to receive a laptop 38 or other electronic device. The surfaces 14, 18, 22, 26, 30 and the cavity 34 may be sized to substantially correspond with the size of the laptop 38 and reduce excess space when the laptop 38 is positioned within the cavity 34. For example, in some embodiments the top and bottom surfaces 14, 18 may be about thirteen inches wide. In other embodiments, the top and bottom surfaces may be about 15 inches wide. In still other embodiments, the top and bottom surfaces 14, 18 may have different dimensions configured to fit an associated laptop or other electronic device. In the illustrated embodiment, the top surface 14 is substantially the same as the bottom surface 18 and the left surface 22 is substantially the same as the right surface 26.

The top surface 14 can be made from multiple panels. For example, the top surface 14 includes a top central panel 42, a first side panel 46*a*, and a second side panel 46*b*. Additionally, the top surface 14 includes a top end panel 50 that has a width substantially equivalent to a combined width of the top central panel 42, the first side panel 46*a*, and the second side panel 46*b*. The top central panel 42 has a trapezoidal shape, the first and second side panels 46*a*, 46*b* have a triangular shape, and the top end panel 50 has a rectangular shape. Together the panels 42, 46, 50 combine to define a rectangular shape. The panels 42, 46, 50 can include various different materials, textures, graphics, or other surface features depending on different aesthetic and performance aspects.

The bottom surface 18 can also be made from multiple panels. For example, the bottom surface 18 includes a bottom central panel 142, a third side panel 146*a*, and a fourth side panel 146*b*. The bottom central panel 142 has a trapezoidal shape, and the third and fourth side panels 146*a*, 146*b* have a triangular shape. Together the panels 142, 146 combine to define a rectangular shape. In the illustrated embodiment, the bottom surface 18 has a greater area than the top surface (e.g., the bottom central panel 142 is larger than the top central panel 42). In other embodiments, the bottom surface 18 may also include a bottom end panel that has a width substantially equivalent to a combined width of the bottom central panel 142, the third side panel 146*a*, and the fourth side panel 146*b*.

Each panel 42, 46, 50 on the top surface 14 is moveable with respect to the other panels 142, 146 on the bottom surface 18. In some embodiments, the panels 42, 46, 50 of the top surface 14 and the panels 142, 146 of the bottom surface 18 can be made from a first material and a second material where the first material has a greater flexibility than the second material. The first material can include fabric, a flexible polymer, or other suitable flexible materials and the second material can include metal, a rigid polymer, or other more materials that are more rigid than the first material. For example, the panels 42, 46, 50 of the top surface 14 and the panels 142, 146 of the bottom surface 18 can be made from metal sheets covered with a fabric material. In other embodiments, the panels 42, 46, 50 of the top surface 14 and the panels 142, 146 of the bottom surface 18 can be made from a different rigid material (e.g., hard plastic). The rigid material may also be covered with a different flexible material.

Hinges 52 can positioned between adjacent panels 42, 46, 50 of the top surface 14 and the panels 142, 146 of the bottom surface 18, and can be formed by joining edges of adjacent panels together. The hinges 52 can include only flexible (or semi-flexible) material, and not a rigid material (i.e., the adjacent rigid panels are slightly spaced apart). This allows the hinges 52 to bend. The hinges 52 can be configured to bend in two directions. In some embodiments, the hinges 52 are capable of bending substantially 180 degrees in both directions.

In the illustrated embodiment, a first hinge 52*a* is between the top central panel 42 and the first side panel 46*a*. A second hinge 52*b* is between the top central panel 42 and the second side panel 46*b*. A third hinge 52*c* is between the top central panel 42 and the top end panel 50. A fourth hinge 152*a* is between the bottom central panel 142 and the third side panel 146*a*. A fifth hinge 152*b* is between the bottom central panel 142 and the fourth side panel 146*b*. A sixth hinge 152*c* is between the bottom central panel 142 and the end surface 30. Adjacent panels may be joined together so that hinges are formed and permit flexible movement (see e.g., FIGS. 9-10). In other embodiments, a single material can be used with living hinge connections between the panels, 42, 46, 50 of the top surface 14 and the panels 142, 146 of the bottom surface 18. In other embodiments, the hinges can be formed by connecting the first material between the second material. For example, a fabric material can be sewn together between the more rigid components to form a hinge. Other types of hinge connections can be used as would be understood by one of ordinary skill.

A securing member or strap 54 is secured to the bottom surface 18 and is removably coupled to the top surface 14 in order to secure the laptop 38 within the cavity 34. In other embodiments, the strap 54 may be secured to the top surface 14, or may be removably coupled to both the top and bottom surfaces 14, 18. In the illustrated embodiments, one end of the strap 54 is fixed to the central panel 42 of the bottom surface 18. The other end of the strap 54 can removably couple to the central panel 42 of the top surface 14. In the illustrated embodiment, the strap 54 includes a magnetic portion, which can couple to the metal sheet that forms the central panel 42 (e.g., the rigid material). In other embodiments, the strap 54 may include a different type of securing mechanism (e.g., Velcro, press stud, snap, etc.). The strap 54 can also includes a padded surface. In the illustrated embodiment, the padded surface is made from an elastomeric material. The padded surface does not interfere with the magnetic force between the strap 54 and the central panel of the top surface 14.

As shown in FIGS. 3-4, and 11-16, the case 10 can be expanded after the laptop 38 is removed from the cavity 34 while the case 10 is in a storage position (see e.g., FIG. 2) in order to position the case 10 in a working configuration. The top central panel 42 is moved away from the bottom central panel 142 (see e.g., FIGS. 11-12). The top central panel 42 moves about the third hinge 52*c*, and moves relative to the bottom central panel 142 (see e.g., FIGS. 14-16). The third hinge 52*c* moves proximate (e.g., comes into contact with) the bottom central panel 142, which causes the top central panel 42 and the top end panel 50 to be angled relative to each other. The top end panel 50 is also angled relative to the bottom central panel 142 (e.g., creating a generally triangular cross-section).

As the top central panel is raised, the first and second side panels 46*a*, 46*b* bend along the first and second hinges 52*a*, 52*b*. Additionally, the third and fourth side panels 146*a*, 146*b* bend along the fourth and fifth hinges 152*a*, 152*b* and are pulled upward with the top central panel 42. The side surfaces 22, 26 fold inwardly along their respective seventh and eighth hinges 53*a*, 53*b* (see e.g., FIGS. 13*a*-13*c*). In other words, panels 62*a*, 162*a* of the first side surface 22, and panels 62*b* and 162*b* of the second side surface 26 rest on top of one another when the case 10 is in the working configuration. The bent side panels 46*a* on respective sides of the central panels 42 (e.g., the left side panels on the top and bottom surfaces 14, 18) substantially contact one another. A height of the opening of the cavity 34 increases as the first through fourth side panels 46*a*, 46*b*, 146*a*, 146*b* fold relative to the top and bottom central panels 42, 142.

When raised fully to the working position (see e.g., FIGS. 3, 4, 12, and 16), the first and second side panels 46*a*, 46*b*, and the third and fourth side panels 146*a*, 146*b* remain angled with respect to the panels 62 of the side surfaces 22, 26, as well as to each other (e.g., the first side panel 46*a* remains angled with respect to the third side panel 146*a*). This enables the first and third side panels 46*a*, and the second and fourth side panels 46*b*, 146*b* to self-lock when the case 10 is in the working configuration (i.e., the weight of the top surface 14 remains supported by the third and fourth side panels 146*a*, 146*b*). The first, second, third, and fourth side panels 46*a*, 46*b*, 146*a*, 146*b* remain in a folded position until an outside force is provided (e.g., user intervention) so that the opening of the cavity 34 remains in the expanded position.

In the illustrated embodiment, the angle between the top central panel 42 and the bottom central panel 142 is approximately 70° and the top central panel 42 and the top end pane 50 are angled approximately 45° apart while the bottom surface 18 is supported by a support surface (e.g., a table, the ground, etc.). In other embodiments, the top central panel 42 may be angled more or less from the top end panel 50, and the top central panel 42 may be angled more or less from the bottom central panel 142.

Figure 5:
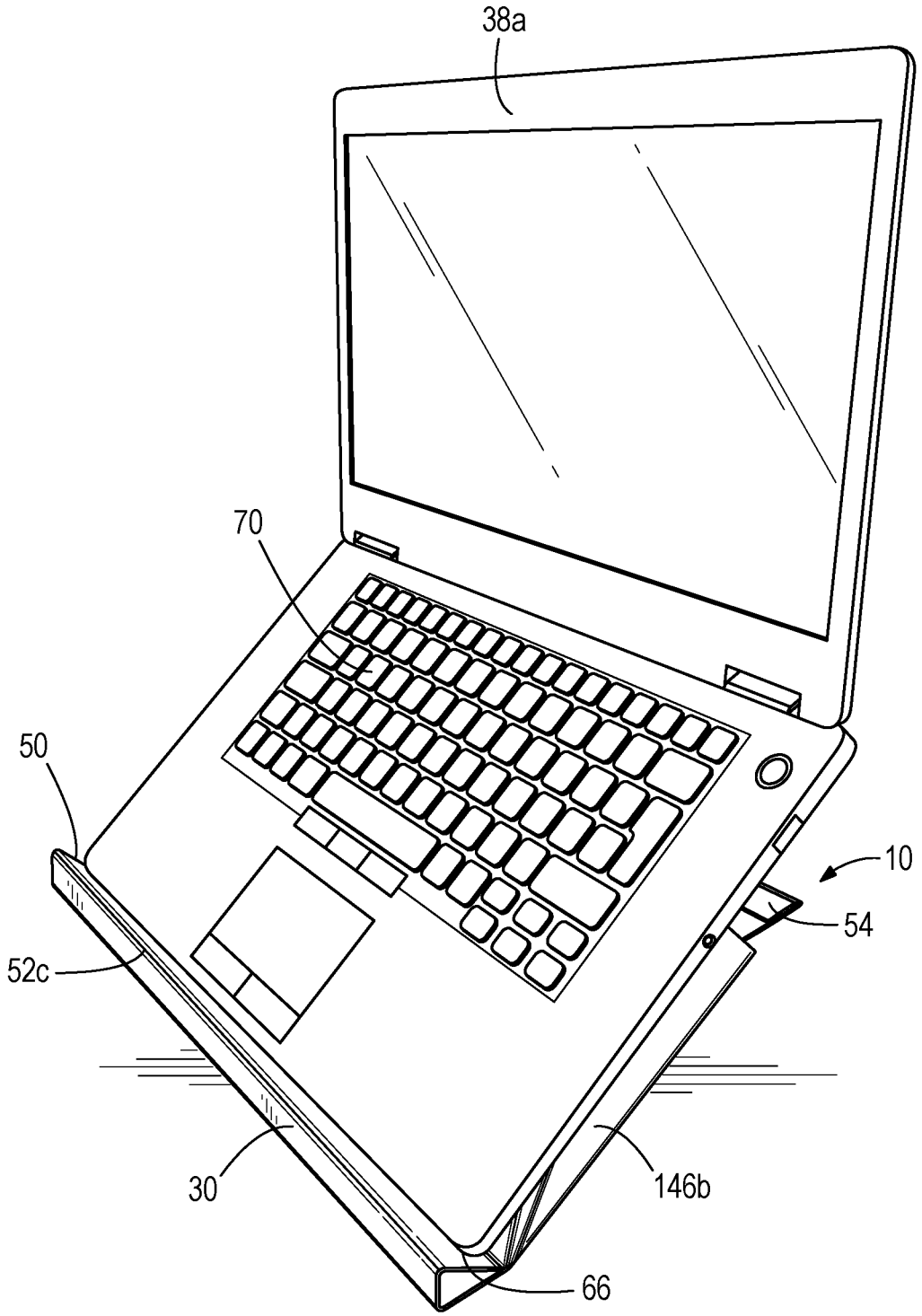
FIG. 5 is a front perspective view of the case of FIG. 1 supporting a laptop in a first configuration.
Figure 17:
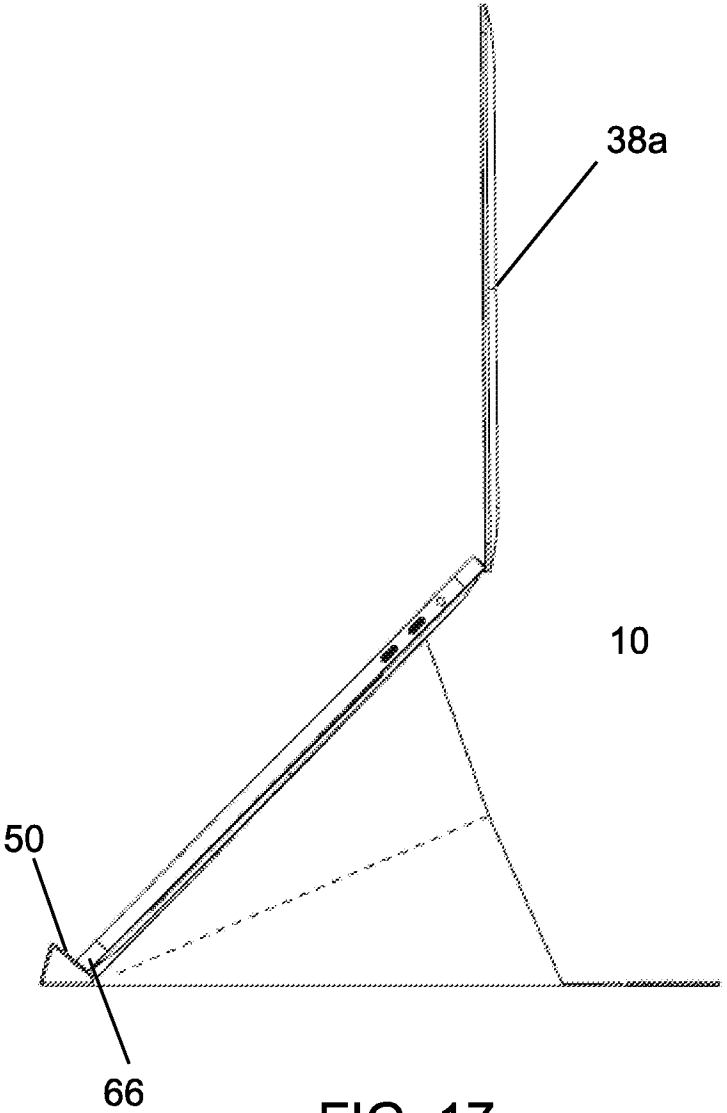
FIG. 17 is a side view of the case of FIG. 1 supporting a laptop in a first configuration.

As shown in FIGS. 5 and 17, a laptop 38*a* can be supported by the case 10 in a first configuration where the bottom surface of the laptop 38*a* rests against the top central panel 42, and a front edge 66 of the laptop 38*a* (i.e., the edge typically facing a user and perpendicular to a surface of the laptop keyboard 70) is positioned proximate the third hinge 52*c*. The triangular structure formed by folding the top end panel 50 and the end surface 3o relative to the bottom central panel 142 creates a stop surface for the laptop 38*a*. In other words, the front edge 66 of the laptop 38*a* is supported by the top end panel 50. The top end pane 50 prevents the laptop 38*a* from sliding along the top central panel 42 and toward the floor.

In the first configuration, the laptop 38*a* can be opened to approximately 135° (i.e., the angle between the laptop keyboard 70 and the screen is 135°). The bottom surface of the laptop 38*a* is resting on the top central panel 42 which is positioned approximately 45° from a support surface (e.g., a table, a user's lap, etc.). When the laptop 38*a* is positioned on the top central panel 42, the screen of the fully opened laptop 38*a* is positioned approximately orthogonal to the support surface. Placing the laptop 38*a* on the case 10 in the first configuration raises a display of the laptop 38*a* to a more comfortable viewing height than if the laptop 38*a* rested directly on the support surface. This may reduce muscular strain associated with extended use of the laptop 38*a*. Alternatively, the laptop 38*a* is positioned on the first configuration of the case 10, and not opened to its maximum angle. In other embodiments, a different laptop 38 may be used, which opens to a different maximum angle, with the first configuration of the case 10.

Figure 6:
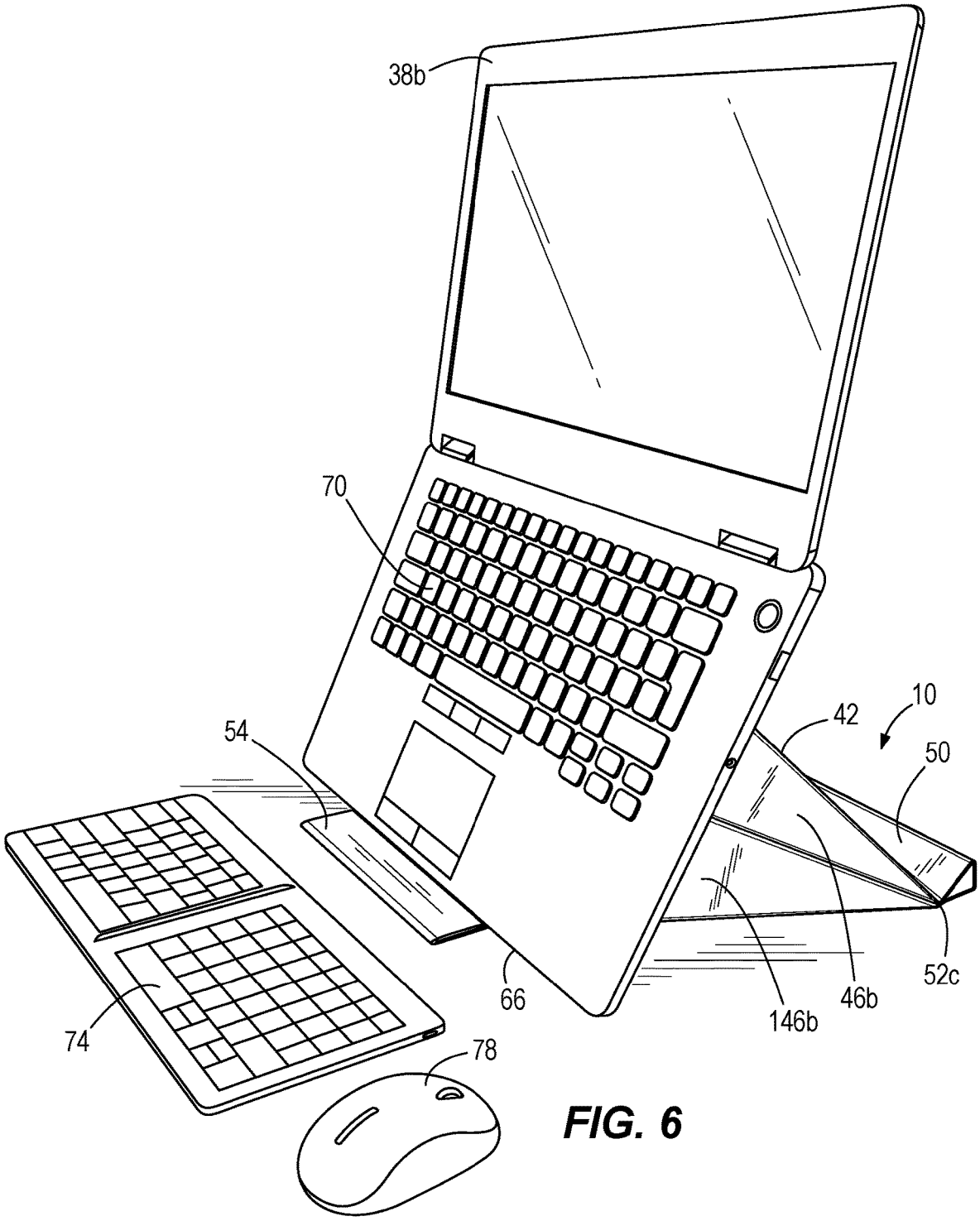
FIG. 6 is a perspective view of the case of FIG. 1 supporting the laptop in a second configuration.
Figure 18:
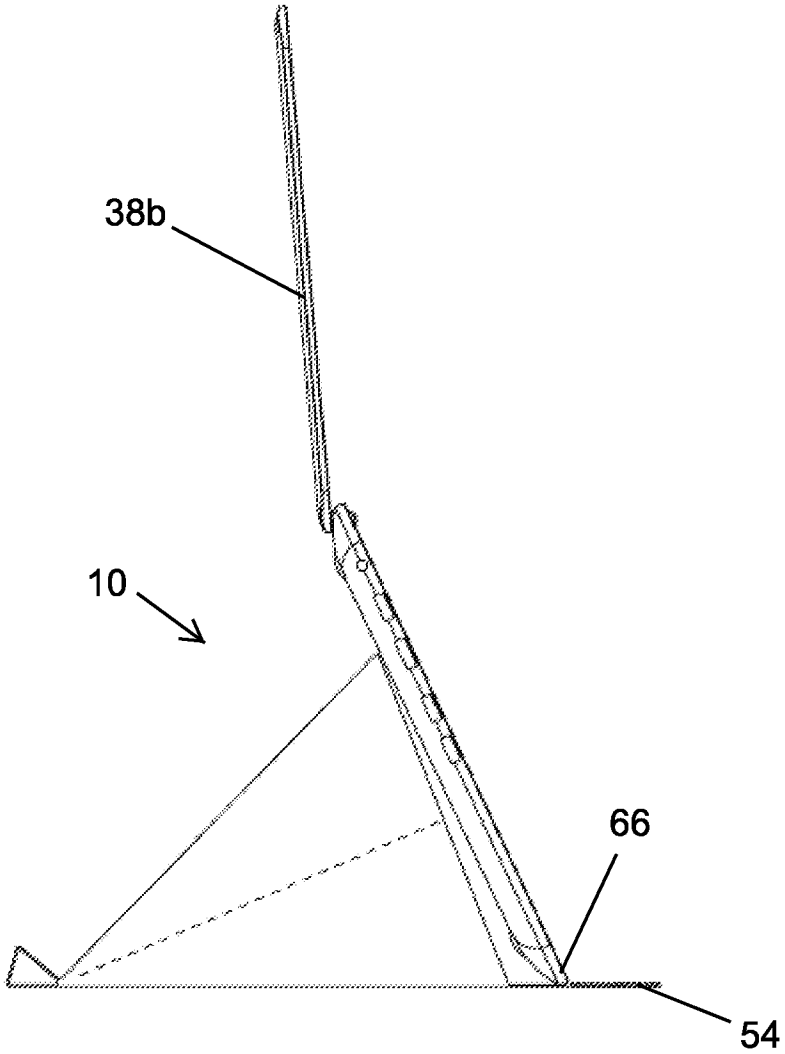
FIG. 18 is a side view of the case of FIG. 1 supporting a laptop in a second configuration.

As shown in FIGS. 6 and 18, a laptop 38*b* also can be supported by the case 10 in a second configuration. The bottom surface of the laptop 38*b* substantially covers the opening of the cavity 34 and rests against edges of the top and bottom central panels 42, 142, as well as the first, second, third, and fourth the side panels 46*a*, 46*b*, 146*a*, 146*b*. The strap 54 is positioned outside of the cavity 34, and away from the bottom central panel 42 so that the front edge 66 of the laptop 38*b* is positioned on the strap 54. The elastomeric material of the strap 54 provides frictional resistance for the laptop 38*b* (i.e., against the bottom edge 66), and assists in preventing the laptop 38*b* from sliding relative to the strap 54. Additionally, the substantially vertical orientation of the laptop 38*b* (e.g., angled at approximately 70°) means that the weight has a greater vertical component than a horizontal component, so that there is less force that the friction force of the strap 54 will have to counteract to prevent horizontal movement.

In the illustrated embodiment, the laptop 38*b* opens to approximately 160° (i.e., the angle between the laptop keyboard 70 and the screen is 160°). In the second configuration, a plane covering the opening to the cavity 34 is positioned approximately 110° from a support surface (e.g., a table, a user's lap, etc.). The laptop 38*b* is positioned within that plane so that the laptop keyboard 70 is also approximately 110° from the support surface while positioned on the second configuration of the case 10. When the laptop 38*b* is positioned on the plane, the screen of the fully opened laptop 38*b* (i.e., opened to 160°) is positioned approximately perpendicular with the support surface. Placing the laptop 38*b* on the case 10 in the second configuration raises a display of the laptop 38*b* to a more comfortable viewing height than if the laptop 38*a* rested directly on the support surface. This may reduce muscular strain associated with extended use of the laptop 38*b*. Alternatively, the laptop 38*b* can be positioned on the second configuration of the case 10 and not opened to its maximum angle. The laptop 38*b* may also be used with a supplemental (e.g., wireless) keyboard 74 and/or mouse 78. In other embodiments, a different laptop 38 may be used, which opens to a different maximum angle, with the second configuration of the case 10.

Figure 7:
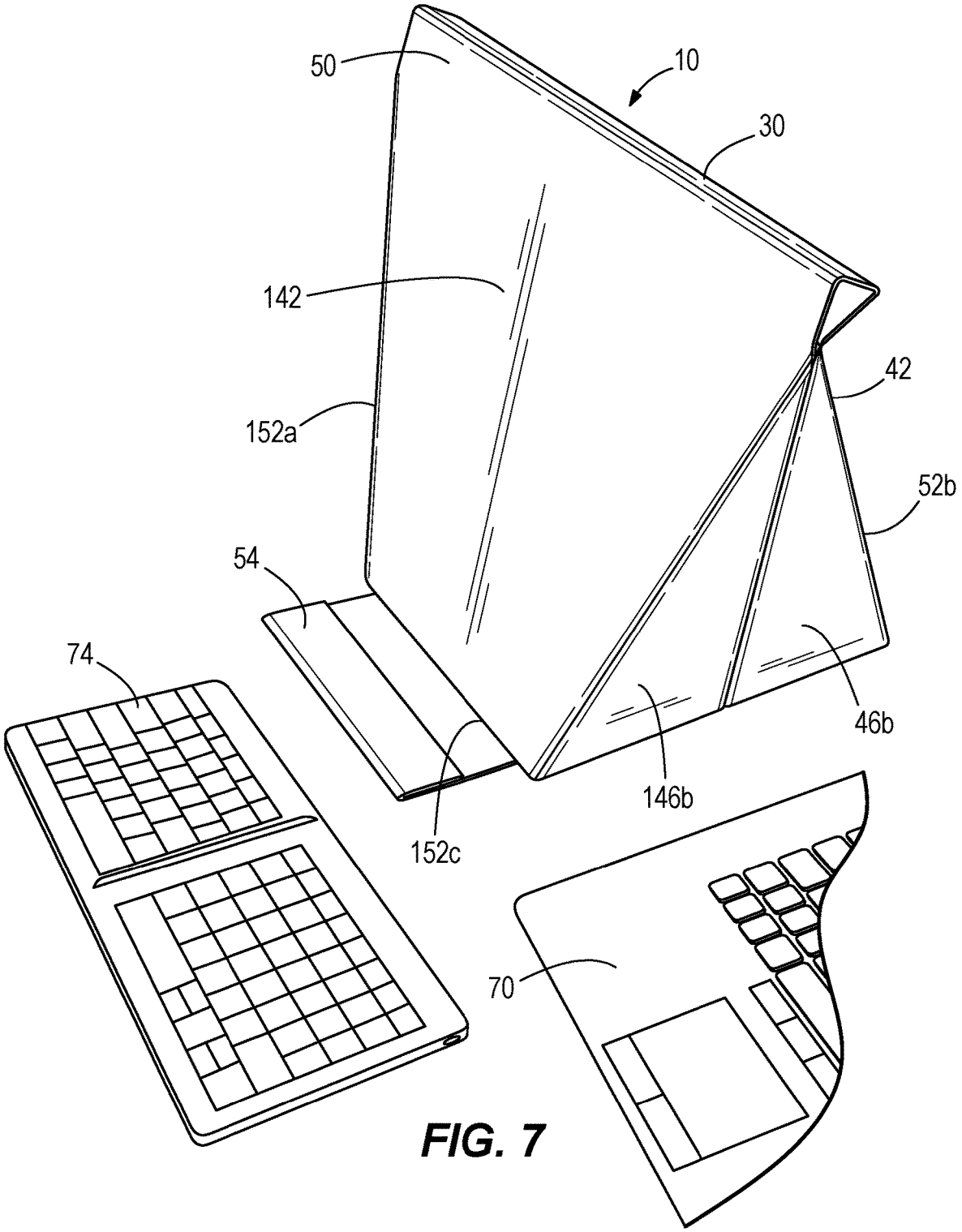
FIG. 7 is a perspective view of the case of FIG. 1 in a second open position.

As shown in FIG. 7, the case 10 can be positioned in a third configuration while expanded. The opening of the cavity 34 is positioned facing the support surface, so that the cavity 34 cannot be accessed. In the illustrated embodiment, the opening of the cavity 34 is substantially flush with the support surface. In the third configuration, the top and bottom central panels 42, 142 are oriented approximately 70° with respect to the support surface. In the illustrated embodiment, the strap 54 includes elastomeric material on both sides, so that elastomeric material is exposed in the third configuration. The top end panel 50, the bottom central panel 142, and the end surface 30 are positioned distal to the support surface and move about the third hinge 52*c* (e.g., because of the force of gravity).

Figure 8:
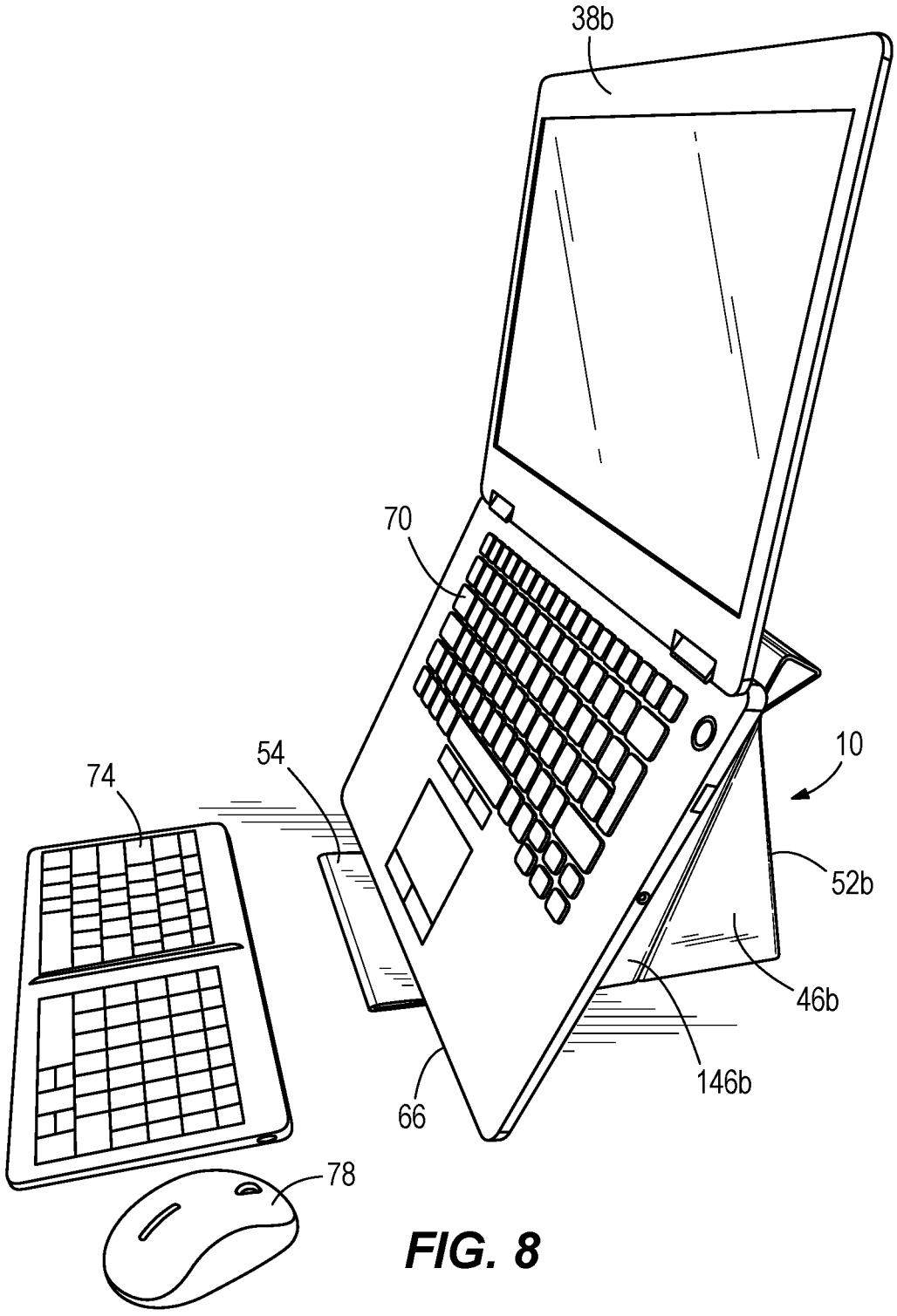
FIG. 8 is a perspective view of the case of FIG. 7 supporting a laptop in a third configuration.
Figure 9:
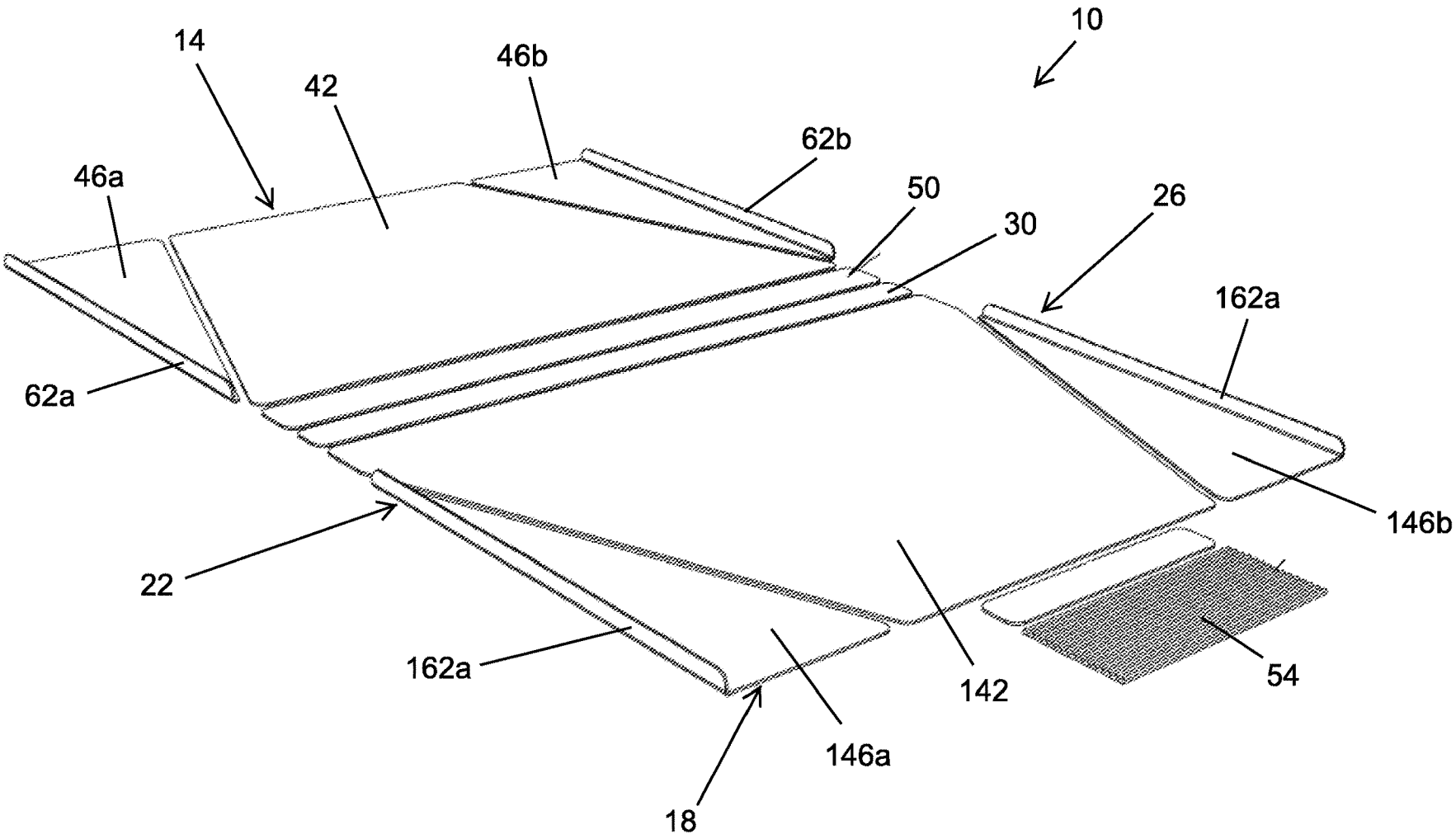
FIG. 9 is a perspective view of the case of FIG. 1, in a first unassembled position showing an internal structure of the case.
Figure 10:
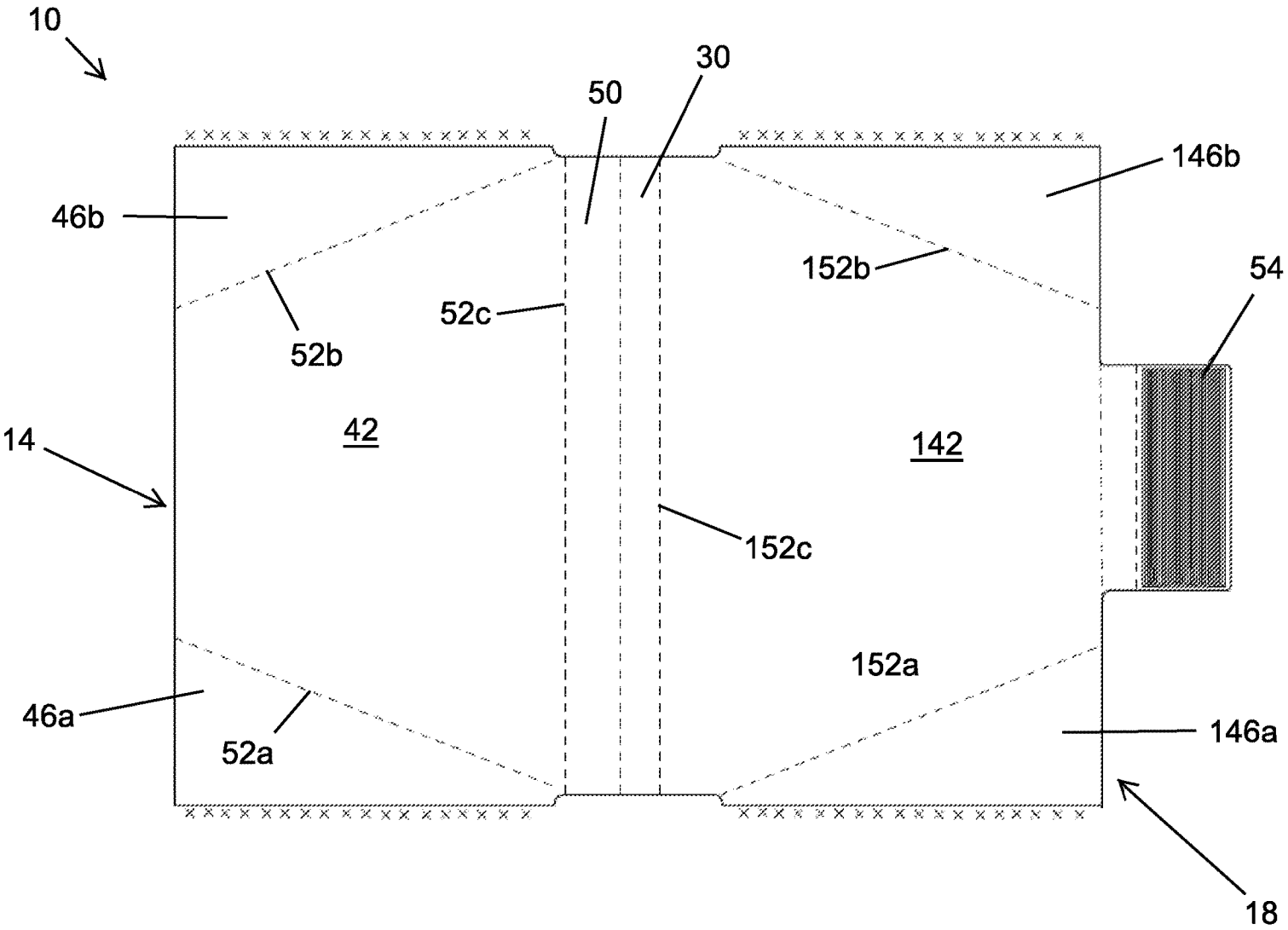
FIG. 10 is a top view of the case of FIG. 9 in a second unassembled position, showing a flexible material covering the rigid structure and illustrating the flexible hinge lines.
Figure 11:
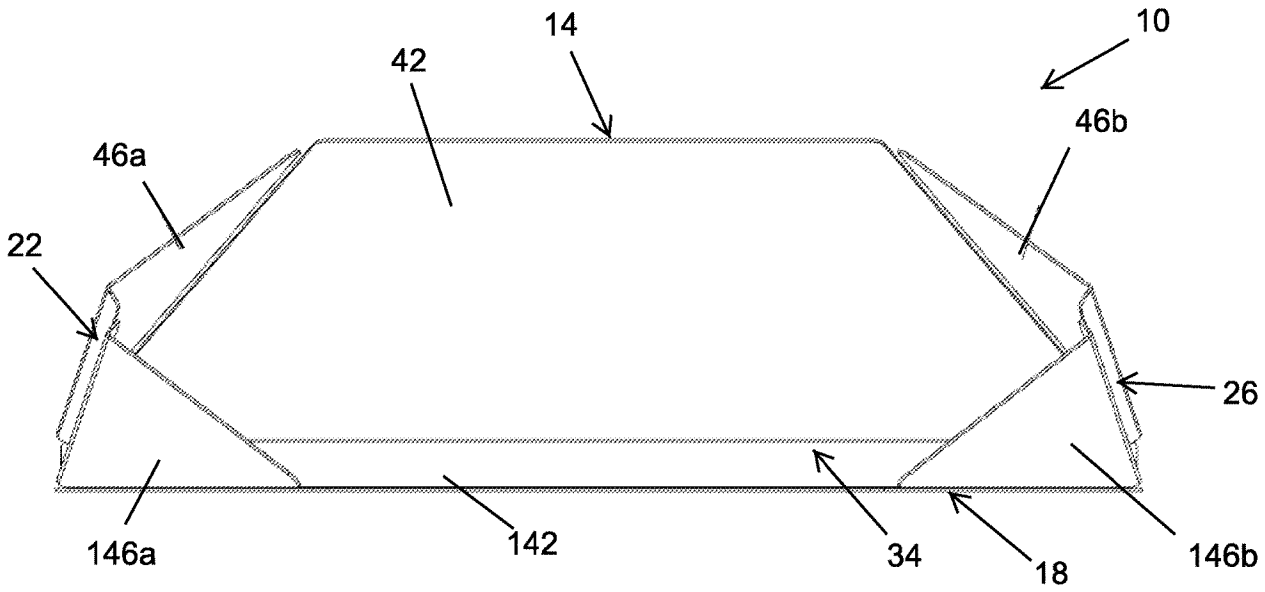
FIG. 11 is a front view of the case of FIG. 1, folding into a working position.
Figure 12:
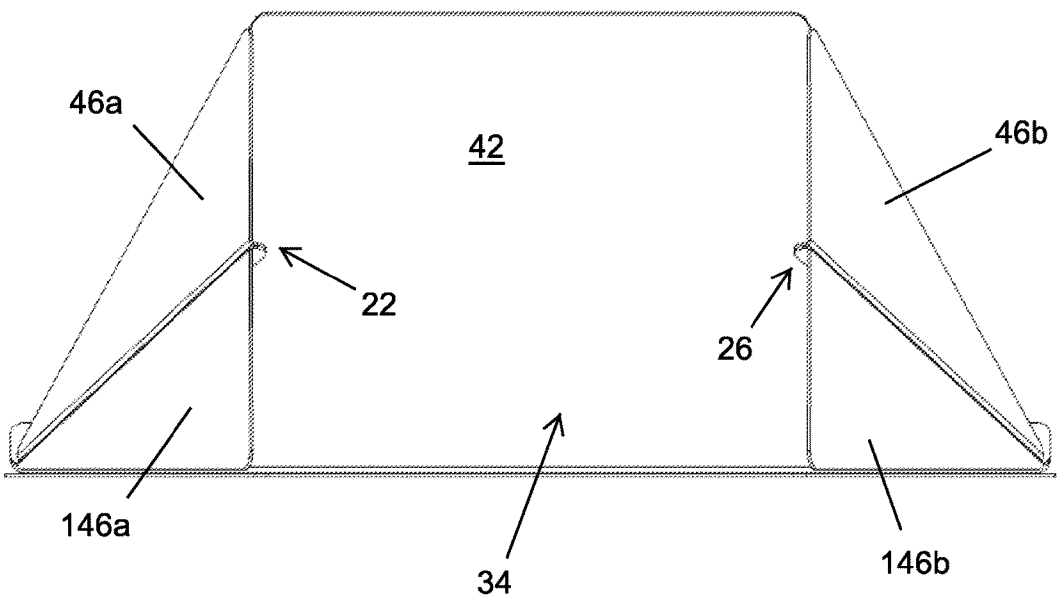
FIG. 12 is a front view of the case of FIG. 1, folded into a working position.
Figure 13C:
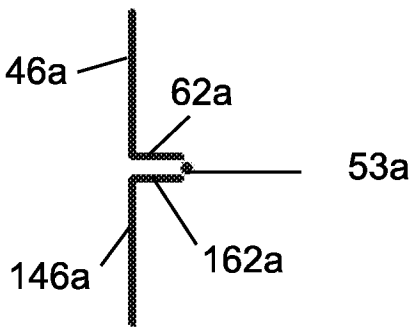
FIGS. 13*a*-13*c* are schematic views of a portion of the case of FIG. 1, folding between a storage position and a working position.
Figure 13B:
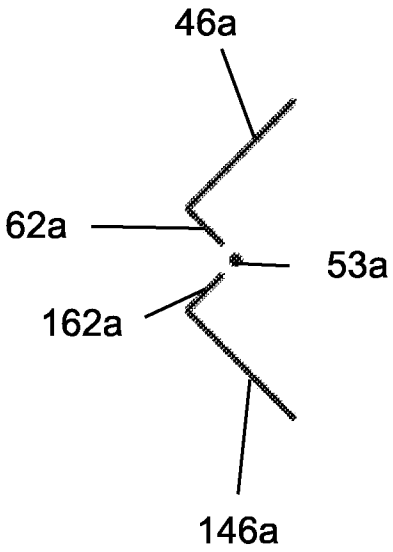
Figure 13A:
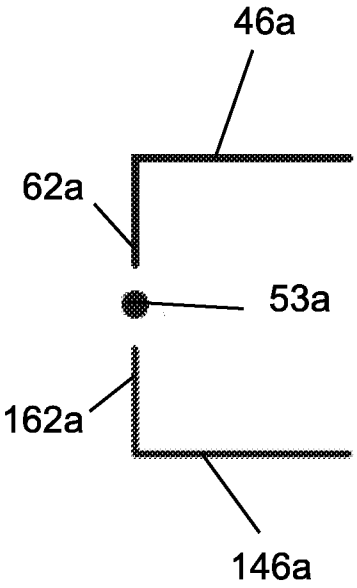
Figure 14:
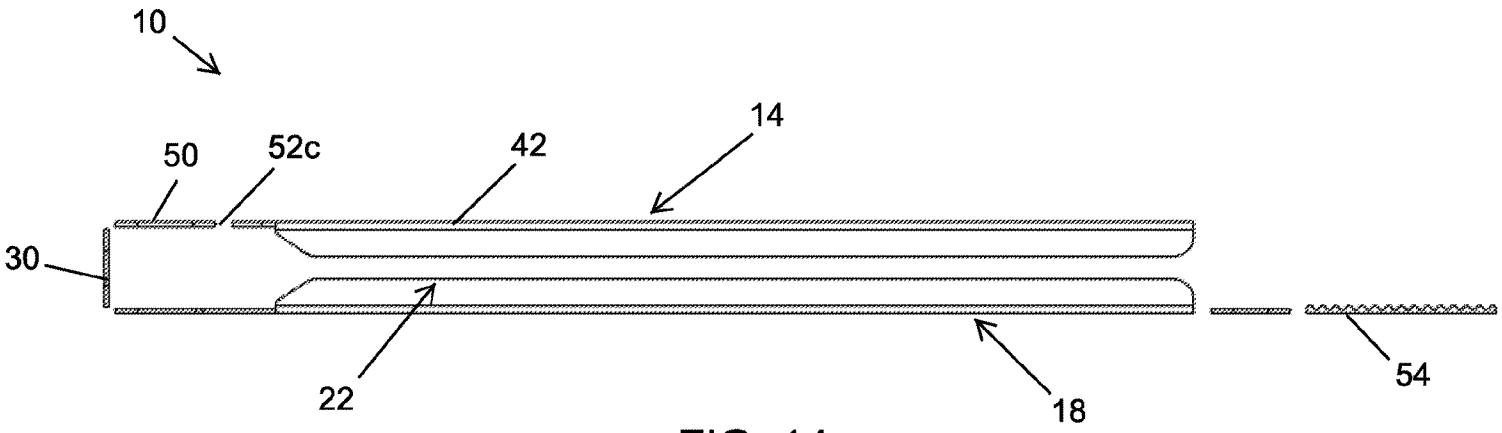
FIG. 14 is a side view of the case of FIG. 1 in a storage position.
Figure 15:
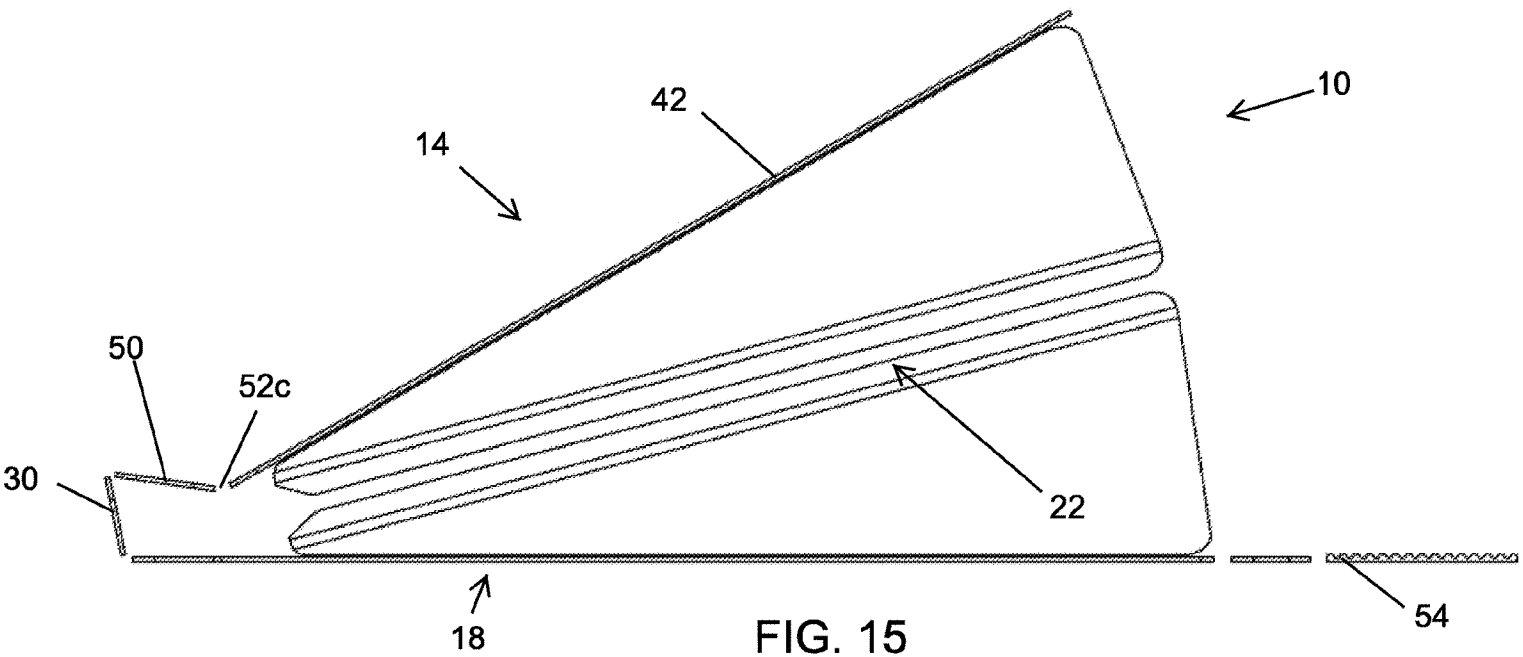
FIG. 15 is a side view of the case of FIG. 1 in an intermediate position.
Figure 16:
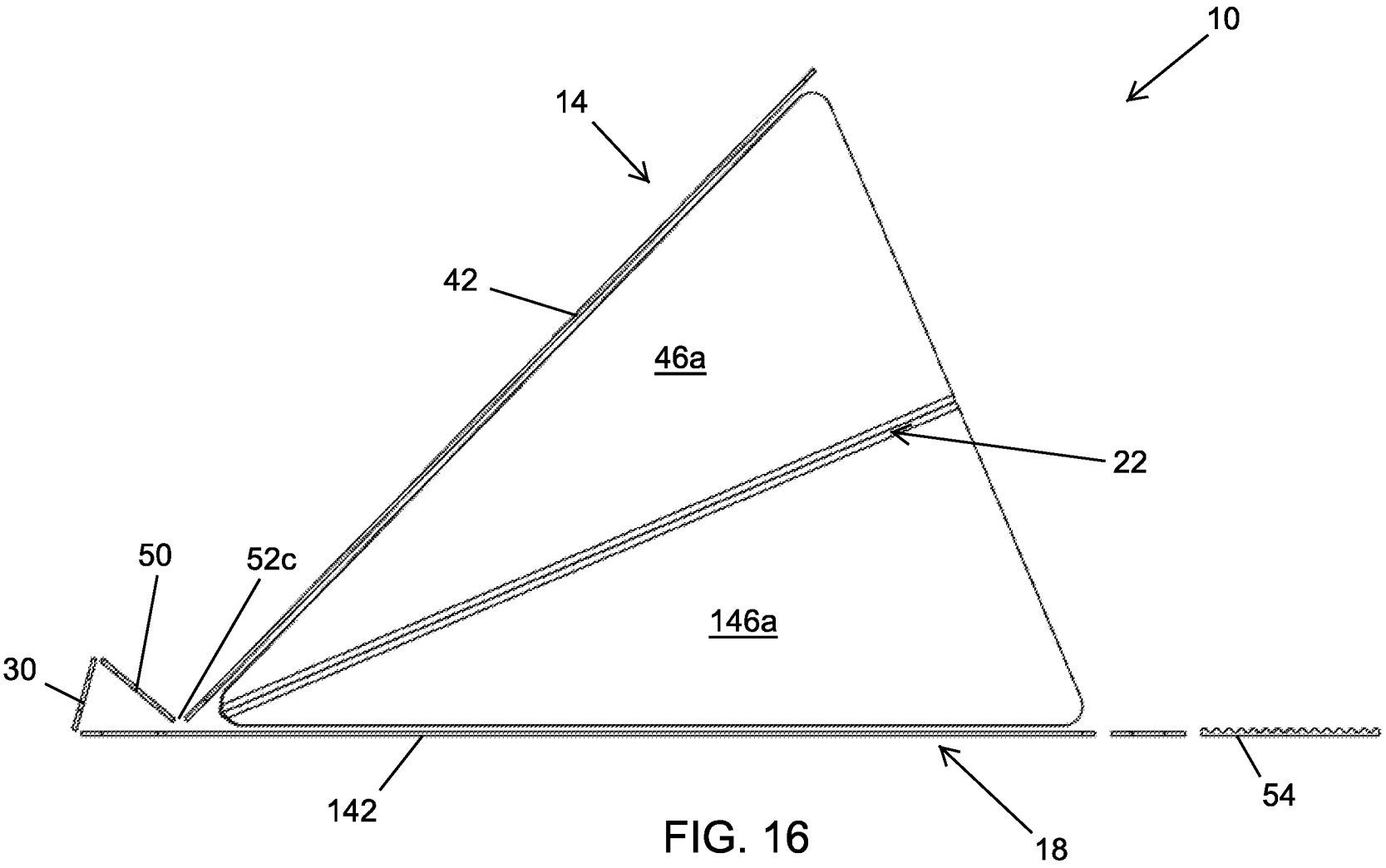
FIG. 16 is a side view of the case of FIG. 1 in a working position.

As shown in FIG. 8, the laptop 38*b* opens to approximately 160° (i.e., the angle between the laptop keyboard 70 and the screen is 160°). When the laptop 38*b* is positioned on either central panel 42, 142, the screen of the fully opened laptop 38*b* (i.e., opened to 160°) is positioned approximately orthogonal to the support surface (i.e., in substantially the same position as the second configuration). The height of the opening of the cavity 34 in the opened position is less than the length of the top surface 14. The third configuration therefore provides a narrower footprint along the support surface than the first or second configurations. This enables the case 10 to be used with a narrower support surface (e.g., a desk) than the case could be used with in the first and second configurations or to take up less space in a working environment. Placing the laptop 38*b* on the case 10 in the third configuration raises a display of the laptop 38*a* to a more comfortable viewing height than if the laptop 38*b* rested directly on the support surface. This may reduce muscular strain associated with extended use of the laptop 38*b*. Alternatively, the laptop 38*b* can be positioned on the third configuration of the case 10, and not opened to its maximum angle. In other embodiments, a different laptop may be used, which opens to a different maximum angle, with the second configuration of the case 10.

The embodiment(s) described above and illustrated in the figures are presented by way of example only and are not intended as a limitation upon the concepts and principles of the present disclosure. As such, it will be appreciated that variations and modifications to the elements and their configuration and/or arrangement exist within the spirit and scope of one or more independent aspects as described.

The invention claimed is:

1. A convertible case for a portable electronic device comprising:

a bottom surface having a first panel;

a top surface moveably coupled to the bottom surface, the top surface having a second panel;

a right surface positioned between the bottom surface and the top surface;

a left surface positioned between the bottom surface and the top surface; and a rear surface positioned between the bottom surface and the top surface and between the right surface and the left surface, wherein the bottom surface, the top surface, the right surface, the left surface, and the rear surface at least partially define a cavity having an opening, wherein the right surface and the left surface are inwardly foldable, wherein the bottom surface and the top surface are moveable with respect to one another between a storage configuration and a working configuration, wherein in the storage configuration the cavity is enclosed by the bottom surface, the top surface, the right surface, the left surface, and the rear surface, wherein in the storage configuration the opening has a first size and the cavity and the opening are sized to receive a portable electronic device, and wherein in the working configuration the opening has a second size larger than the first size, and the bottom and top surface are positioned to support the portable electronic device, wherein the top surface includes a first side panel moveably coupled to the second panel with a first hinge, a second side panel moveably coupled to the second panel with a second hinge, and an end panel moveably coupled to the second panel with a third hinge.

2. The convertible case of claim 1, wherein the first panel and the second panel are positioned substantially perpendicular to the opening in the storage configuration and at least one of the first panel and the second panel extend at an oblique angle to the opening in the working configuration.

3. The convertible case of claim 1, wherein in the working configuration the portable electronic device can be supported resting on one of the panels.

4. The convertible case of claim 1, wherein in the working configuration the portable electronic device can be supported resting on a major surface of one of the panels or on an edge of at least one of the panels.

5. The convertible case of claim 1, further comprising a securing member secured to the bottom surface and removably coupled to the top surface in the first storage configuration.

6. The convertible case of claim 1, wherein the top surface is inclined approximately 45° relative to the bottom surface in the working configuration.

7. A convertible case for a portable electronic device comprising:

a bottom surface including a first central panel, a first side panel moveably coupled to the first central panel with a first hinge, a second side panel moveably coupled to the first central panel with a second hinge, and a first end panel moveably coupled to the first central panel with a third hinge;

a top surface moveably coupled to the bottom surface, the top surface including a second central panel, a third side panel moveably coupled to the second central panel with a fourth hinge, a fourth side panel moveably coupled to the second central panel with a fifth hinge, and a second end panel moveably coupled to the second central panel with a sixth hinge;

a right surface positioned between the bottom surface and the top surface and moveably coupled to one of the bottom surface or the top surface; and a left surface positioned between the bottom surface and the top surface and moveably coupled to one of the bottom surface or the top surface, wherein the bottom surface, the top surface, the left surface, and the right surface at least partially define a cavity and an opening, wherein the bottom surface is moveable relative to the top surface between a first position and a second position, wherein in the first position the cavity is enclosed by the bottom surface, the top surface, the right surface, and the left surface, wherein the size of the opening increases as the bottom surface moves between the first position and the second position, and wherein the right surface and the left surface fold inwardly as the bottom surface moves between the first position and the second position.

8. The convertible case of claim 7, wherein the first central panel is trapezoidal in shape and the first side panel is triangular in shape.

9. The convertible case of claim 7, further comprising a securing member secured to the first central panel and removably coupled to the second central panel in the first position.

10. The convertible case of claim 7, wherein the first and second side panels are angled relative to the first central panel in the second position, and the third and fourth side panels are angled relative to the second central panel in the second position.

11. The convertible case of claim 10, wherein the first and second side panels are angled relative to the third and fourth side panels in the second position, the first and second side panels support the weight of the top surface in the second position.

12. The convertible case of claim 7, wherein the second central panel is inclined approximately 45° relative to the bottom surface in the second position.

13. The convertible case of claim 7, wherein second end panel is inclined approximately 45° relative to the bottom surface in the second position.

14. The convertible case of claim 7, wherein the first central panel and the second central panel include a rigid material and the first hinge is a living hinge.

15. The convertible case of claim 7, wherein the left surface includes a first left panel and a second left panel connected by a seventh hinge, and wherein the left surface folds inwardly along the seventh hinge to move to the second position.

16. The convertible case of claim 15, wherein the first left panel rests on top of the second left panel in the second position.

* * * * *